United States Patent [19]

Fukushi et al.

[11] Patent Number: 4,618,245

[45] Date of Patent: Oct. 21, 1986

[54] IMAGE FORMING APPARATUS AND ATTACHMENT WHICH TOGETHER ENTER AN ENERGY SAVING MODE

[75] Inventors: Yukihiro Fukushi, Kawasaki; Hiroyuki Segawa, Tokyo, both of Japan

[73] Assignee: Kabushiki Kaisha Toshiba, Kawasaki, Japan

[21] Appl. No.: 730,634

[22] Filed: May 6, 1985

[30] Foreign Application Priority Data

May 10, 1984 [JP] Japan ..... 59-93192

[51] Int. Cl.[4] ..... G03G 15/20; G03G 21/00

[52] U.S. Cl. ..... 355/14 SH; 355/14 FU; 355/3 FU; 355/3 SH

[58] Field of Search ..... 355/14 SH, 14 FU, 14 R, 355/3 R, 30, 14 C, 3 SH, 3 FU

[56] References Cited

U.S. PATENT DOCUMENTS

| | | | |
|---|---|---|---|
| 3,926,519 | 12/1975 | Rebres | 355/14 FU |
| 4,161,644 | 7/1979 | Yanagawa | 355/14 FU |
| 4,330,200 | 5/1982 | Kikuchi et al. | 355/14 SH |
| 4,515,458 | 5/1985 | Masuda et al. | 355/14 SH |

*Primary Examiner*—R. L. Moses

*Attorney, Agent, or Firm*—Schwartz, Jeffery, Schwaab, Mack, Blumenthal & Evans

[57] ABSTRACT

A copying or printing machine connected with an attachment such as a sorter, including a microcomputer for controlling a copying or printing operation, a power supply for energizing the machine, and a power reducing device for reducing electric power to be supplied to a copy fixing device of the machine by the power supply so that less electric power is consumed than during operation.

The microcomputer keeps the attachment in an inactive status, provided that the power reducing device reduces electric power to be supplied to the copy fixing device.

12 Claims, 12 Drawing Figures

IMAGE FORMING APPARATUS AND ATTACHMENT WHICH TOGETHER ENTER AN ENERGY SAVING MODE

BACKGROUND OF THE INVENTION

This invention relates to an image forming apparatus including a copying machine and a printer, in which an energy saving mode and an attachment such as a sorter are provided.

Copying machines are provided with a sorter as an attachment for optional use. This sorter is mounted on a copy sheet discharge portion of the copying machine. The copy sheets, copied in the copying machine, are collected in the sorter bins in order of discharge from the discharge port.

Further, the copying machines include a fuser for heating and pressing copy sheets to fix copy images thereon. This fuser is kept at a fixable temperature in standby status to permit copying operation at any time. Accordingly, electric power is always supplied to the fuser and, when the copier is not being used, is wasted.

To avoid this problem, copying machines are recently being provided with an energy saving mode of operation. After this mode is established, the temperature of fuser is kept lower than the fixable temperature, so that the copying machine turns to an inactive status.

When an attachment such as the sorter is mounted on the copying machine provided with an energy saving mode, however, the following problems arise.

The sorter is not installed previously, but is mounted on the copying machine as a user option, so that the operation condition of the sorter is not established cooperatively according to that of the copying machine.

Therefore, the power supply switch of the sorter must be operated each time when the copying machine is set in energy saving mode. It is possible that the switching operation of the sorter may be forgotten when energy saving mode is released.

SUMMARY OF THE INVENTION

Accordingly, it is an object of the present invention to provide an image forming apparatus with an attachment which may be set in an energy saving mode according to the operational mode of the image forming apparatus.

Another object of the present invention is to provide an image forming apparatus which is convenient to use and which is excellent in operability.

These and other objects are achieved by providing a novel image forming apparatus with an attachment including means for forming an image on a recording medium, means for supplying a first level of electric power for energizing the image forming means for image forming operation, means for reducing the electric power supplied to the image forming means by the supplying means to a second level lower than the first level so that less electric power is consumed than during operation, means for generating a control signal in response to the reduction of electric power supplied to the image forming means, and control means for keeping the attachment in an inactive status in response to the control signal.

BRIEF DESCRIPTION OF THE DRAWINGS

A more complete appreciation of the invention will be readily obtained by reference to the following detailed description when considered in connection with the accompanying drawings, wherein.

DETAILED DESCRIPTION OF THE PREFERRED EMBODIMENTS

Figure 1:
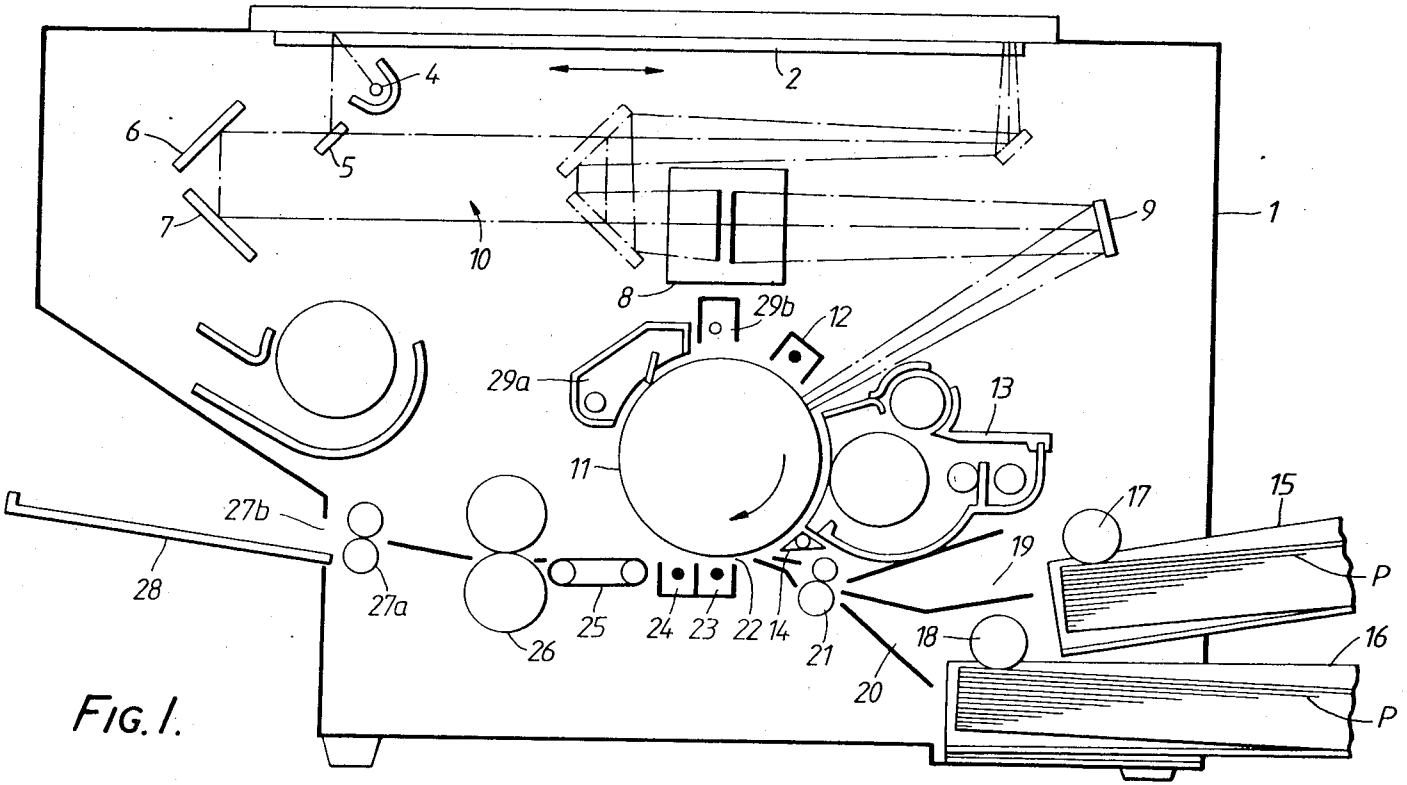
FIG. 1 is a front view of the inside of a copying machine incorporating the present invention.

FIG. 1 shows the inside of the copying machine schematically as an embodiment of an image forming apparatus according to the present invention.

An original platen 2 having transparent glass plate for supporting an original document on the surface thereof, is provided on an upper surface of a main body 1.

Below platen 2, an exposure lamp 4 and mirrors 5, 6 and 7 reciprocated in the direction of arrow as shown in FIG. 1, are provided. Further, a lens block 8 and a fixed mirror 9 are provided. Lens block 8 is moved along an optical axis according to copy magnification.

Exposure lamp 4, mirrors 5, 6 and 7, lens block 8 and fixed mirror 9 define an optical system 10.

By the scanning operation of optical system 10 for the original document supported on platen 2, an image of the original is formed on a surface of a drum 11 provided with a photosensitive layer on the surface thereof. Drum 11 is rotated in the direction of arrow in FIG. 1. The surface of drum 11 is charged previously by a corona discharger 12, and then the image of the original is projected on the surface by the scanning operation, so that an electrostatic latent image is formed on the surface. This electrostatic latent image is visualized by depositing toner particle at a developing device 13. After that, the surface of drum 11 is discharged by an erase lamp 14 before the toner image is transferred.

Copy sheets P are accommodated in paper cassettes 15 and 16. Copy papers P are taken out one-by-one from the selected cassette 15 or 16 by a feed roller 17 or 18. Paper P thus taken out is guided to a transferring station 22 through a paper guide passage 19 or 20 by a register roller 21. Copy sheet P sent to transferring station 22, closely contacts the surface of drum 11 opposing to a transfer charger 23. The toner image formed on drum 11 is transferred on the surface of copy sheet P by the operation of charger 23.

Copy sheet P with its transferred toner image is separated electrostatically from the surface of drum 11 by a separation charger 24. After that, copy sheet P is transported to a fuser 26 such as heated rollers through a paper transportation device 25. As the copy sheet passes thereinto, the transferred image is fixed on copy sheet P by means of heat and pressure of fuser 26. Fixed copy sheet P is discharged outside main body 1 by discharge rollers 27*a* to be accumulated on a tray 28 through a discharge port 27*b*. After transfer, residual toner on the surface of drum 11 is removed by a cleaner 29*a*. Also, any residual electrostatic image is discharged by an erase lamp 29*b*. Thus, the copying machine returns to an initial status. Tray 28 is mountably provided on discharge port 27*b* of main body 1.

Figure 2:
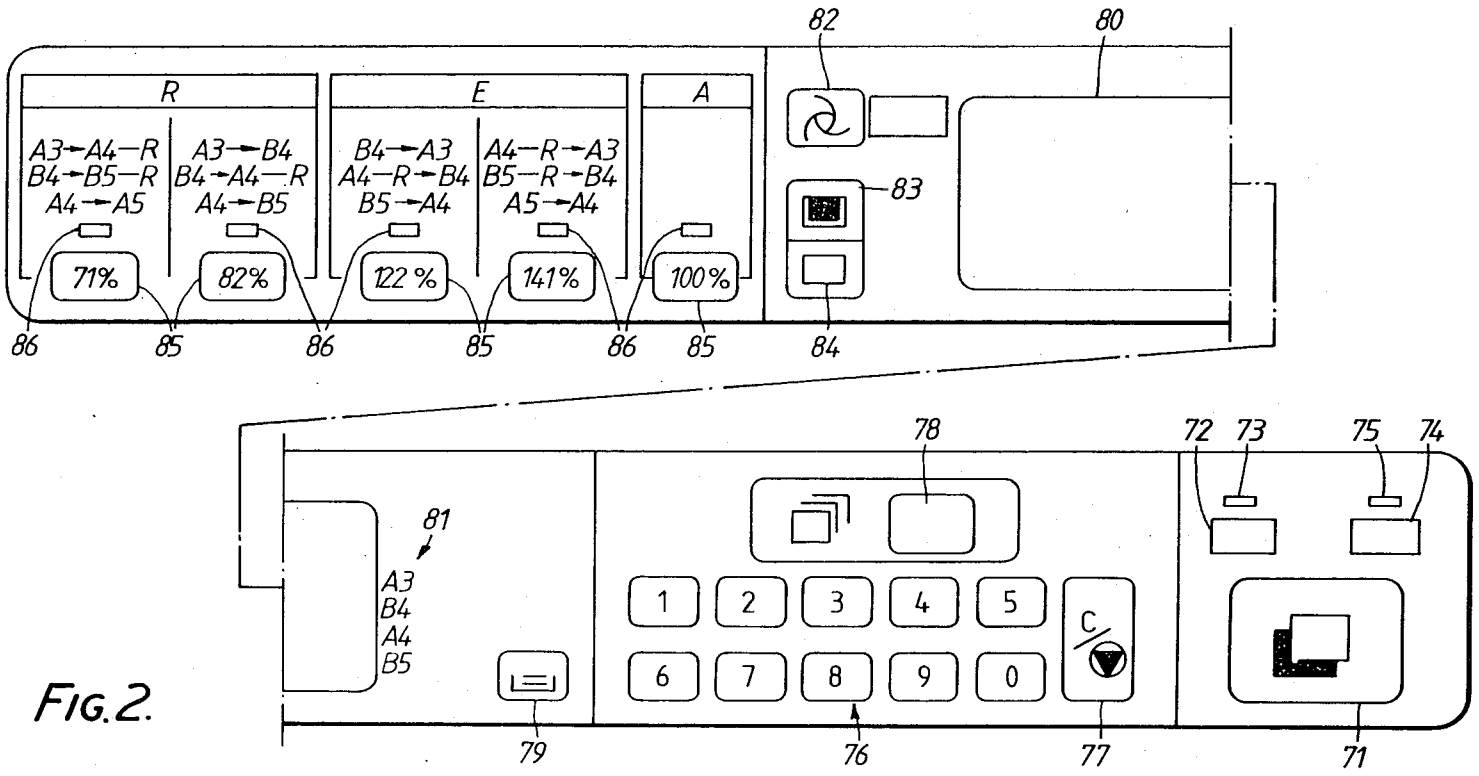
FIG. 2 is a plan view of an operation panel of the copying machine shown in FIG. 1.

Referring to FIG. 2, an operation panel is provided with a print key 71 for starting the copying operation, an interrupt key 72 for designating an interrupt copying mode, and an interrupt display 73 for indicating that interrupt key 72 is operated. There are also provided an energy saving key 74 for designating an energy saving mode and an energy saving display 75 for indicating that the energy saving key 74 has been operated.

Further, there are provided digital keys 76 for setting copy quantity, a clear/stop key 77 for clearing the set quantity and for stopping copying operation, a quantity display 78 for displaying the copy quantity, and a paper selection key 79 to select one of cassettes 15 and 16. Also there are provided a liquid crystal display 80 for indicating various conditions such as selected copy density, machine conditions, and selected paper size cooperating with a display 81 where designation for the selected paper size (for example A3, B4, A4 and B5) is displayed.

Further, there are provided an automatic exposure key 82 for selecting an automatic exposure mode where the optimum copy density is automatically obtained, a light key 83 for lightening the copy density, and a dark key 84 for darkening the copy density. Keys 83 and 84 thus permit selecting a manual exposure mode where a desired copy density may be selected. Also provided are copy magnification selecting keys 85 for selecting the copy magnification (for example 71%, 82%, 122%, 141% and 100%), and magnification displays 86 for indicating selected copy magnification.

Figure 3:
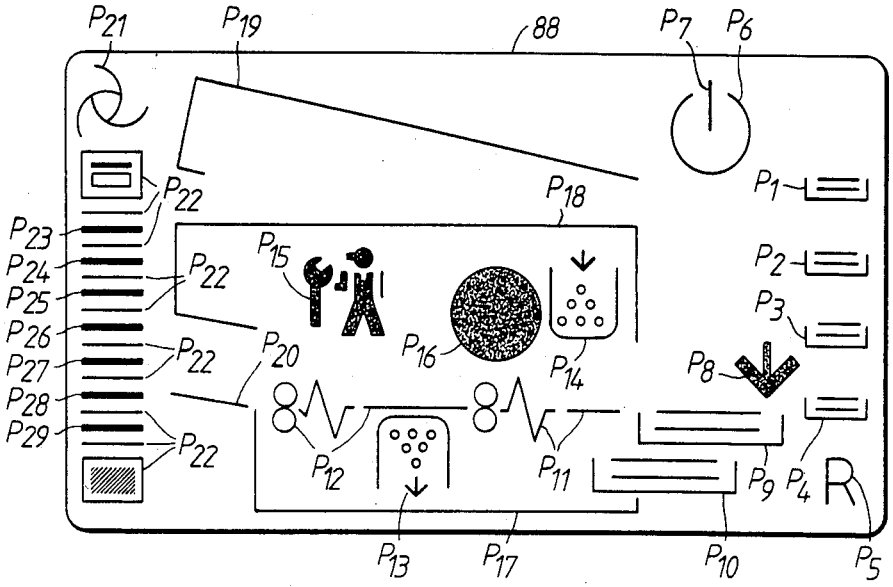
FIG. 3 is a plan view of a liquid crystal display panel of the operation panel shown in FIG. 2.

Referring to FIG. 3, various display patterns are located on a liquid crystal display panel 88 of display 80.

References P1–P4 designate display patterns indicating the size of copy sheet P stored in the selected cassette cooperating with display 81, and reference P5 designates a display pattern indicating that copy sheet P is set to be transported along the longitudinal direction.

Further, references P6 and P7 designate display patterns indicating if the copying machine is under a standby status for copying operation. Display pattern P6 alone indicates the machine is ready for copying operation and indicates the machine is warming up cooperating with display pattern P7. Reference P8 designates a display pattern indicating that no copy sheet is accommodated in the paper cassette. Reference P9 and P10 designate display patterns indicating that paper cassettes 15 and 16 are mounted. References P11 and P12 designate display patterns indicating the occurrence of paper jam at somewhere along the paper transportation passage.

Reference P13 designates a display pattern indicating that cleaning device 29*a* is full of recovered toner. Reference P14 designates a display pattern for indicating that it is necessary to replenish the toner in developing device 13.

Reference P15 designates a display pattern indicating a failure in the copying machine. Reference P16 designates a display pattern indicating drum 11. References P17, P18 and P19 designate display patterns indicating main body 1. Reference P20 designates a display pattern indicating tray 28. Reference P21 designates a display pattern indicating that the copying machine is in an automatic exposure mode. Reference P22 designates a display pattern for displaying a scale which shows the level of a copy density selected in manual exposure mode. References P23–P29 designate display patterns indicating the selected copy density in manual exposure mode. These patterns are displayed selectively with display pattern P22 for indicating any of the selected density of 7 grades.

Figure 4:
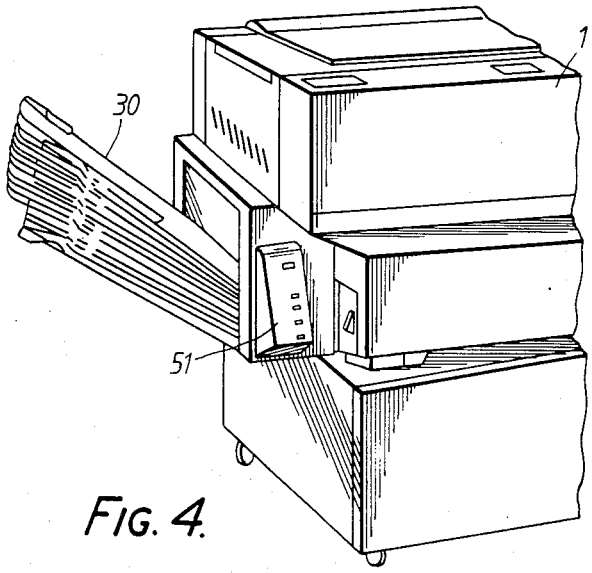
FIG. 4 is a perspective view showing a construction where a sorter is mounted on the copying machine.
Figure 5:
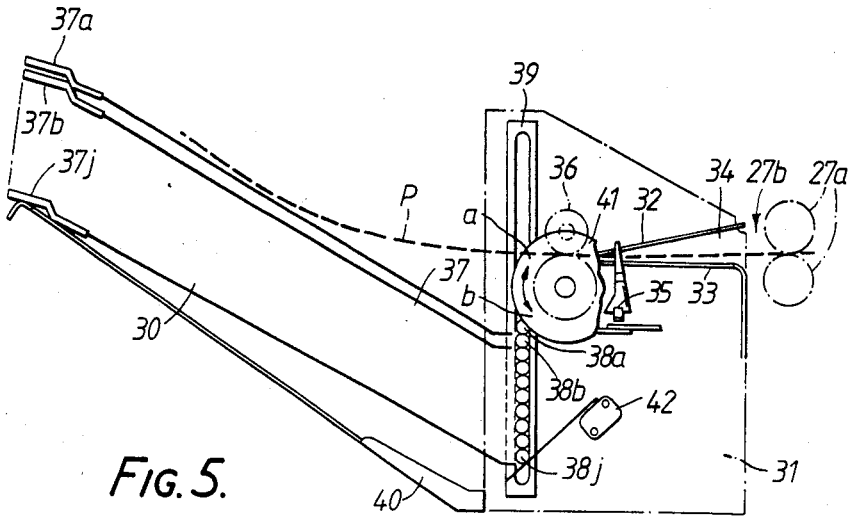
FIG. 5 is a front view showing the inside of the sorter shown in FIG. 4.

Referring to FIGS. 4 and 5, a sorter 30, as an attachment, is mounted on discharge port 27*b* of main body 1 instead of tray 28, which has been removed. Therefore, copy sheet P, discharged from discharge port 27*b* of main body 1, is transported along a transportation passage 34 provided between guides 32 and 33 in a casing 31 as shown in FIG. 5. A paper detection switch 35 is located at a position in transportation passage 34. Paper detection switch 35 detects copy sheet P discharged from main body 1 and actuates rollers 36 for conveying copy sheet P in response to the detection. Copy sheet P is transported through transportation passage 34, and is fed into a bin station 37. This bin station 37 includes 10 bins 37*a*–37*j*. These bins are vertically separated, so that copy sheets P are accommodated on the surface of each bin. Referring to FIG. 5, the left ends of bins 37*a*–37*j* are free ends, and the other ends are sustained respectively by rollers 38*a*–38*j* one-by-one. Rollers 38*a*–38*j* are fixed on the other ends of bins 37*a*–37*j* rotatably, and are received slidably in a groove 39 of casing 31. Bins 37*a*–37*j* are energized upwardly by a spring (not shown).

The free end of bin 37*j* is placed on a supporter 40 which is fixed to casing 31 of sorter 30.

Bins 37*a*–37*j* are slid vertically one-by-one by a cam 41 cooperating with each rollers 38*a*–38*j*. Further, a switch 42 is provided for detecting that bin 37*j* is placed at the initial position where upper bin 37*a* is located so as to receive copy sheet P.

In this embodiment, sorter 30 has three operation modes:

(1) Non-sort mode where sorter 30 is operated in the same manner as tray 28;

(2) Sort mode where bins 37*a*–37*j* are slid respectively to receive a set of copies in the order of the original pages; and (3) Group mode where bins 37*a*–37*j* are slid respectively to receive a plurality of copies corresponding to every page of original.

In the non-sort mode, all of copy sheets are stored in bin 37*a* and bins 37*a*–37*j* are not slid.

In the sort mode, cam 41 is rotated in the direction of arrow a, so that bin 37*a* is moved upwardly after copy sheet P has been stored therein. Bins 37*a*–37*j* are moved one-by-one for sorting until the final copy sheet may be stored.

In the group mode, one or more copies are reproduced from one original, and the copies are stored in bins 37*a*–37*j*.

When the operation mode of sorter 30 is changed or initialized, cam 41 is rotated in the direction of arrow b until switch 42 is operated by bin 37*j*. As a result, bin station 37 is placed at the lowest position.

Figure 6:
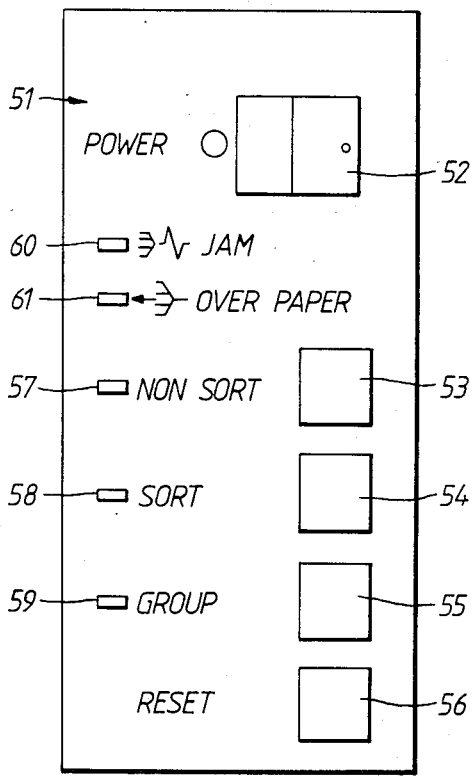
FIG. 6 is a plan view of an operation panel of the sorter shown in FIG. 4.

FIG. 6 shows an operational panel 51 of sorter 30. Operational panel 51 is provided with a power supply switch 52, a non-sort mode switch 53 for designating non-sort mode, a sort mode switch 54 for designating sort mode and a group mode switch 55 for designating group mode. Further, a reset switch 56 for resetting each of the above-mentioned modes, displays 57, 58 and 59 for indicating the selected operation mode, a display 60 for indicating paper jam and a display 61 for indicating copy sheets are over stored in the bin, are provided on panel 51.

Figure 7:
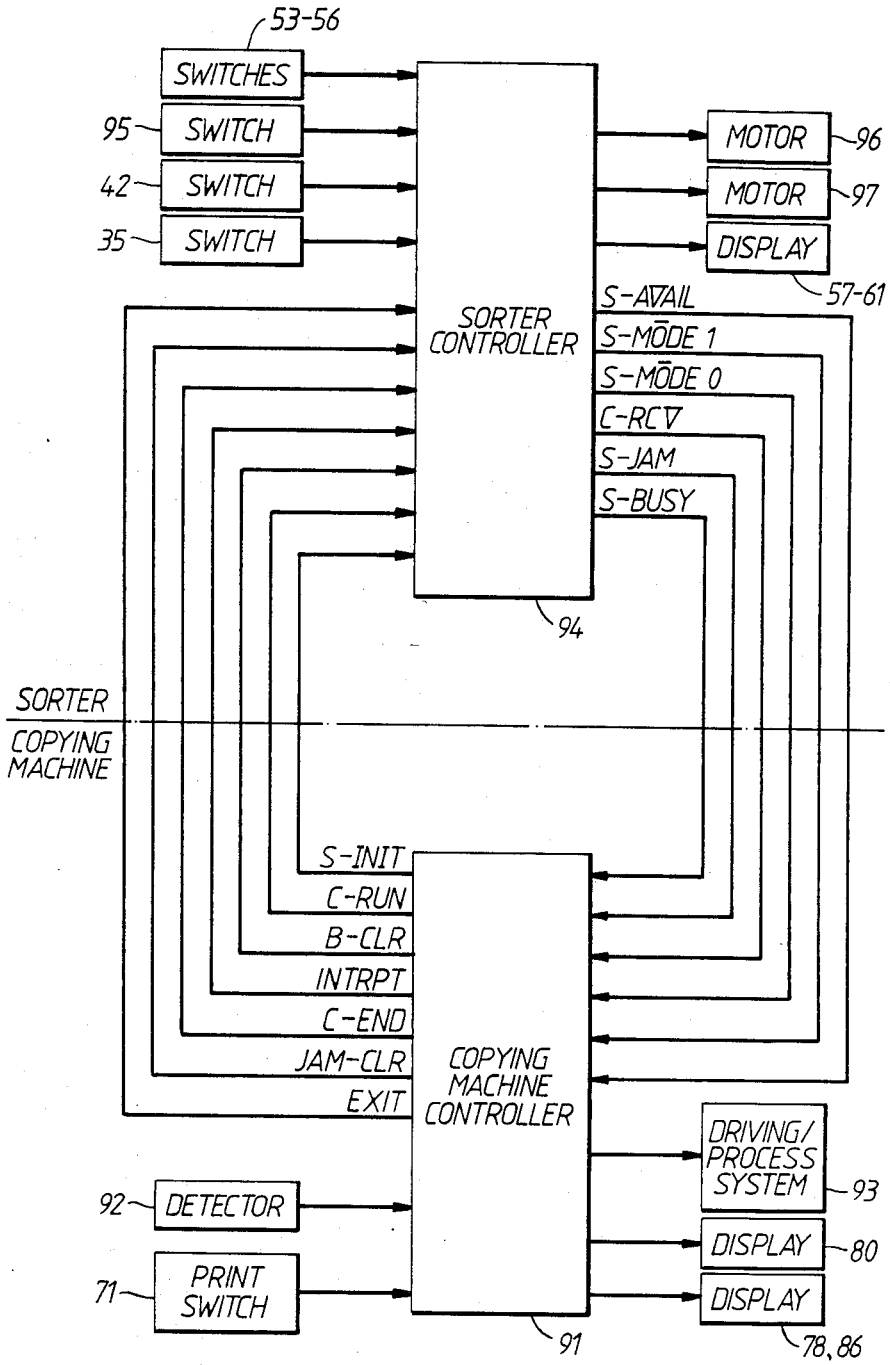
FIG. 7 is a block diagram showing a control device for controlling the operation of the copying machine and the sorter.

Referring to FIG. 7, explanation will be given regarding a control device for controlling the operation of the copying machine.

First, a copying machine controller 91 receives signals from print switch 71 and a detector 92, and controls a driving/process system 93, display unit 80, and displays 78 and 86. Controller 91 is mainly constituted of a microcomputer and peripheral devices, and is operated to perform various operation according to a sequence control program previously stored in read only memory (ROM).

Next, a sorter controller 94 receives signals from switches 35 and 42, a switch 95 for detecting the position of cam 41, and switches 53–56, and controls motors 96 and 97, so that the selected operation mode is performed. Sorter controller 94 is also constituted of a microcomputer and peripheral devices, and is operated to execute various operations according to a control program previously stored in ROM. Motor 96 is used for rotating transportation rollers 36, and motor 97 is used for rotating cam 41. Sorter controller 94 actuates motor 96 so as to rotate rollers 36, when the leading edge of copy sheet P is detected by detection switch 35. After the trailing edge of copy sheet P passes over the position of switch 35, sorter controller 94 stops motor 96 so as to stop the rotation of rollers 36.

Further, copying machine controller 92 and sorter controller 94 are connected each other by means of signal lines, when sorter 30 is mounted on main body 1.

That is, a sorter initialize signal S-INIT, an interrupt copy signal INTRPT, a bin initialize signal B-CLR, a copy run signal C-RUN, a jam release signal JAM-CLR, a paper exit signal EXIT, and a final copy signal C-END are output from controller 91 and input into controller 94.

The S-INIT signal reaches a high level when the power supply of the machine is turned off, when the machine is under energy saving mode, and when the copying machine operation is initialized according to time-out of a timer. Thus, displays 57-61 go out, and motors 96 and 97 are stopped by sorter controller 94 in response to the S-INIT signal. Machine conditions of sorter 30 and the position of bins 37*a*–37*j* are initialized by sorter controller 94, when the S-INIT signal changes from high level to low level.

The INTRPT signal reaches a high level when the machine is under interrupt copying mode. According to the INTRPT signal, sorter controller 94 controls to move bins 37*a*–37*j* so that copy sheets reproduced in the interrupt copying mode are stored in the uppermost bin, after copy sheets reproduced in the previous mode are stored in bins 37*b*–37*j*. Bin station 37 is returned to the position to allow restarting copying operation in the previous mode, when the INTRPT signal changes from high level to low level.

The B-CLR signal reaches a high level for a predetermined time period after set copy quantity is changed or cleared. In the sort mode, sorter controller 94 actuates bin station 37 to move to the initial position according to the B-CLR signal.

The C-RUN signal becomes high during copying operation. Responding to the C-RUN signal, sorter controller 94 does not change the operation mode of sorter 30 even if switches 53–56 output signals for changing the operation mode.

The JAM-CLR signal reaches a high level when a front cover of main body 1 is opened and a door switch is operated to detect the opened cover. A jam status of sorter 30 is released and motors 96 and 97 are stopped in response to the JAM-CLR signal.

The EXIT signal reaches a high level while copy sheet P passes discharge port 27*b*. Sorter controller 94 detects jam status in sorter 30 if switch 35 is not released within a predetermined time period after the EXIT signal changes from high level to low level.

The C-END signal reaches a high level when one copy run is performed and the last copy sheet is discharged from discharge port 27*b*. In response to the C-END signal, controller 94 controls to store the number of sorting and to move bins 37*a*–37*j* reversely in sorter mode. In group mode, however, controller 94 controls to move bins 37*a*–37*j* one-by-one according to the C-END signal.

Then, a sorter operation signal S-BUSY, a sorter jam signal, S-JAM, sorter mode signals S-MODEO and S-MODE1, a copy sheet store signal C-RCV, and a sorter connection signal S-AVAIL are output from controller 94. These signals are input into controller 91.

The S-BUSY signal reaches a high level when switches 53–56 are operated for changing the sorter operation mode, when the power supply of sorter 30 is turned off, and when the copying machine enters the interrupt copying mode. In response to the S-BUSY signal, controller 91 controls to interrupt the copy run and to light display patterns P6 and P7 so that restarting of copy operation is prohibited.

The S-JAM signal reaches a high level when jamming has occurred and sorter 30 falls in a jam status. Responding to the S-JAM signal, controller 91 controls to interrupt copying operation of the machine and to inhibit restarting the copying operation until the S-JAM signal is turned to low level.

The S-MODEO and S-MODE1 signals are used for detecting the operation condition of sorter 30 and the allowable number of bins accompanying with the S-INIT signal. For example, these signals indicate the allowable number of bins when the S-INIT is at high level, and they indicate the operation mode of sorter 30 when the S-INIT is at low level. In response to the S-MODEO, S-MODE1 and S-INIT signals, quantity display 78 is flickered and copying operation is not executed, when a copy quantity more than the allowable number of bins is specified in sort mode.

The C-RCV signal reaches a high level for a predetermined time period after the trailing edge of copy sheet P is stored in bins 37*a*–37*j*. By this signal, controller 91 may detect the quantity of copy sheets P stored in sorter 30 and correct the copy quantity when sorter 30 falls in a jam status.

The S-AVAIL signal is used for detecting the connecting condition between sorter 30 and main body 1, so that controller 91 controls the machine by a control program including sorter operation sequence.

Next, explanation will be given regarding operation. In the embodiment described below, sorter 30 instead of tray 28 is mounted on discharge port 27*b* of main body 1. Therefore, sorter controller 94 and copying machine controller 91 are also electrically connected, and the S-AVAIL signal is supplied to copying machine controller 91.

Figure 8A:
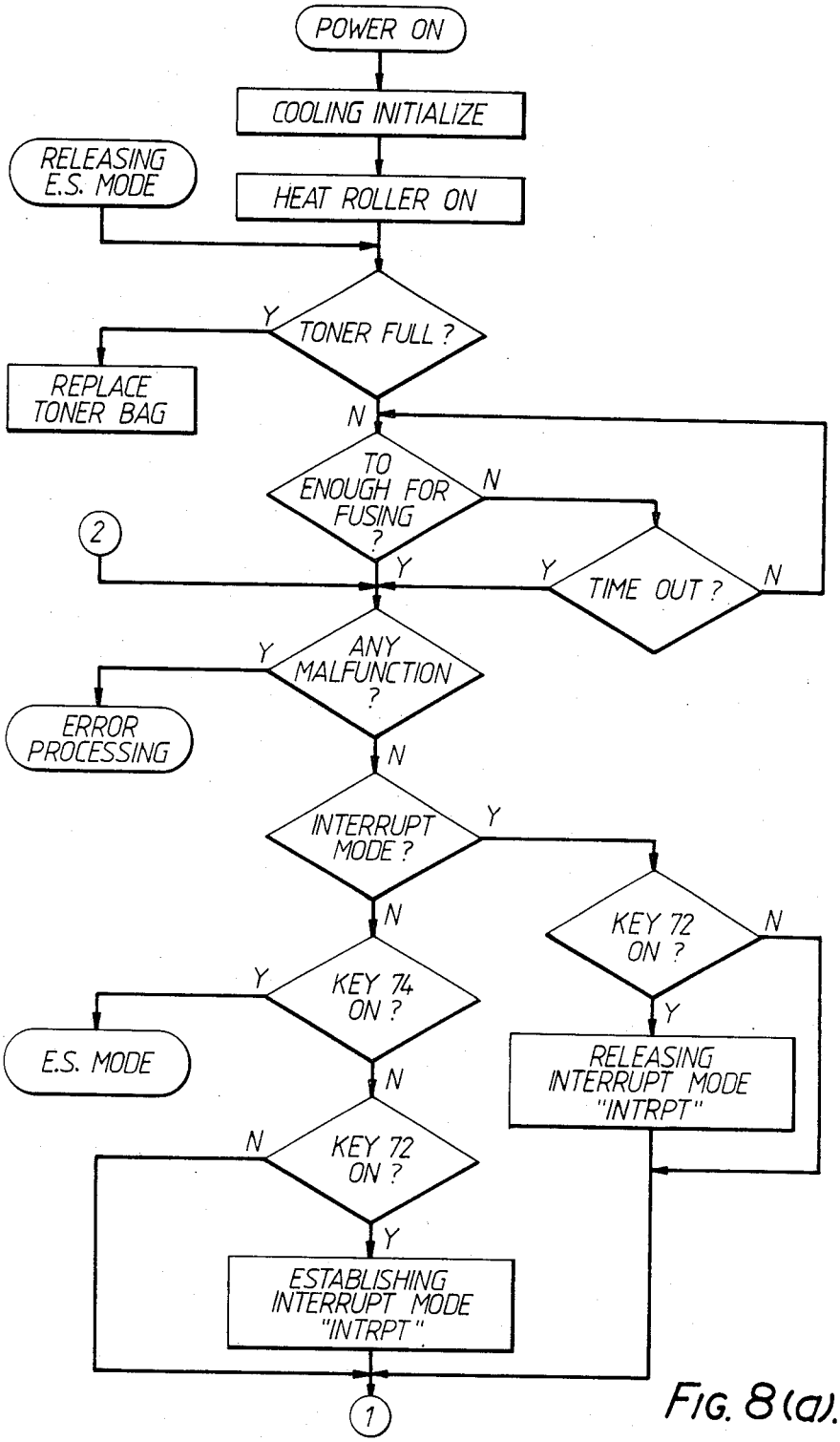
FIG. 8(*a*), (*b*), (*c*), (*d*) and (*e*) are flowcharts for explaining the control sequence of the control device shown in FIG. 7.
Figure 8:
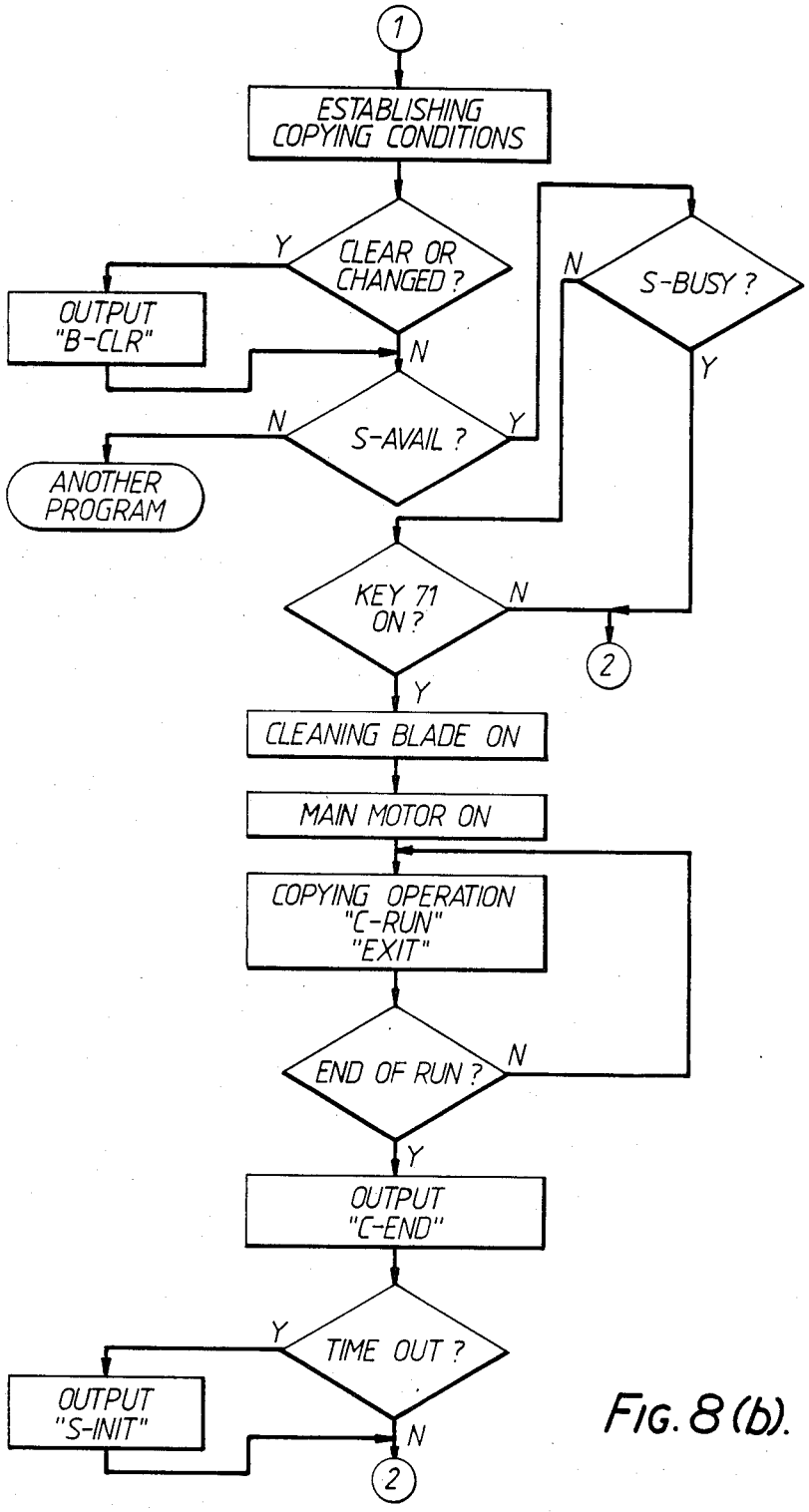
Figure 8:
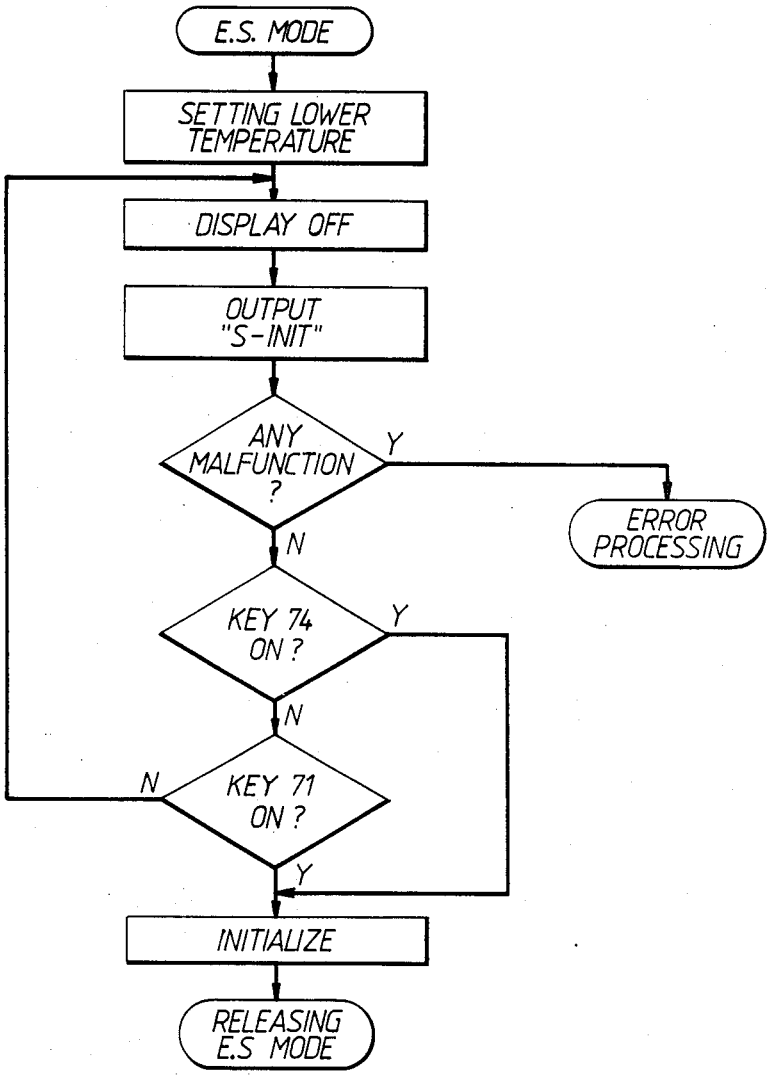
Figure 8D:
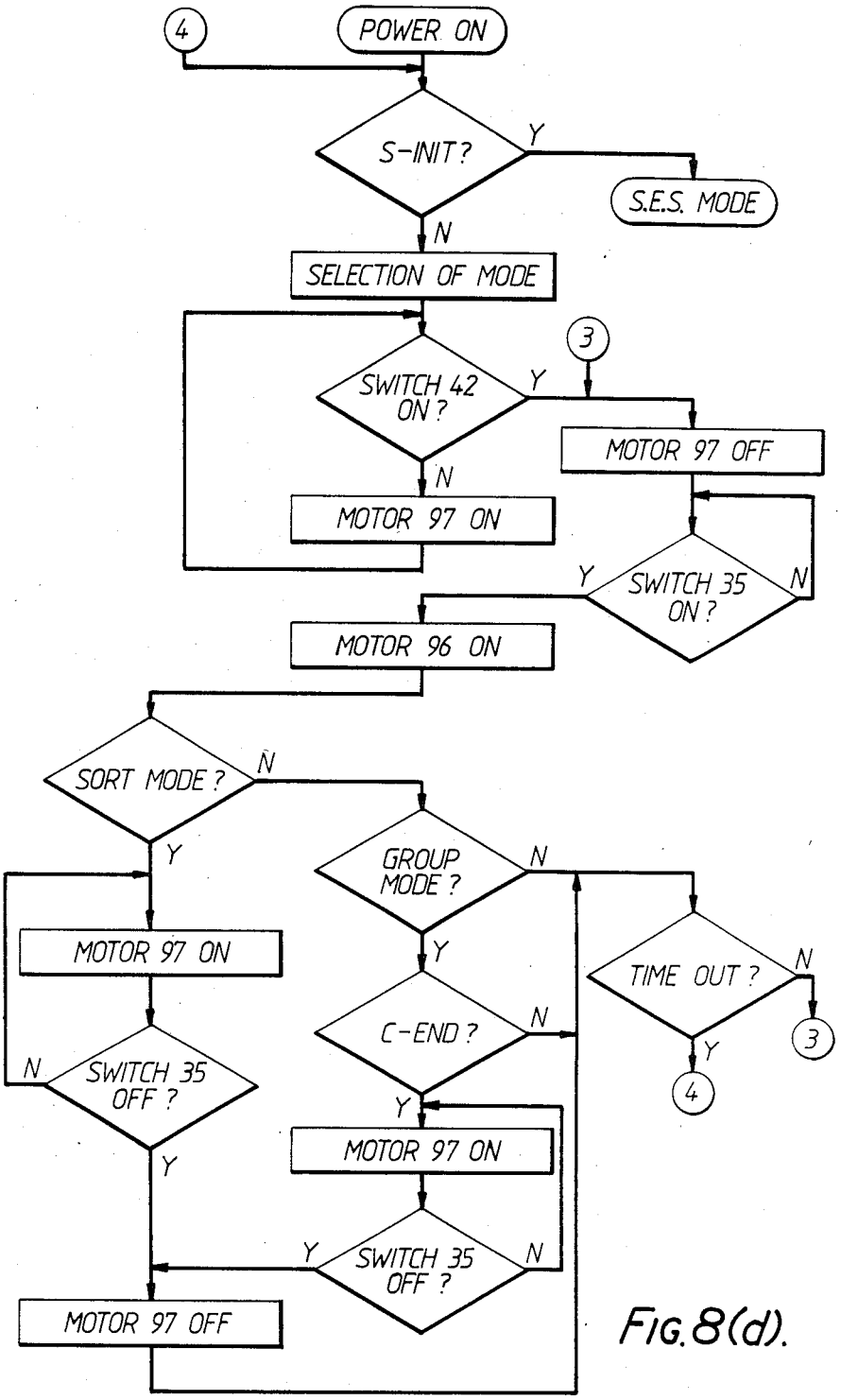
Figure 8E:
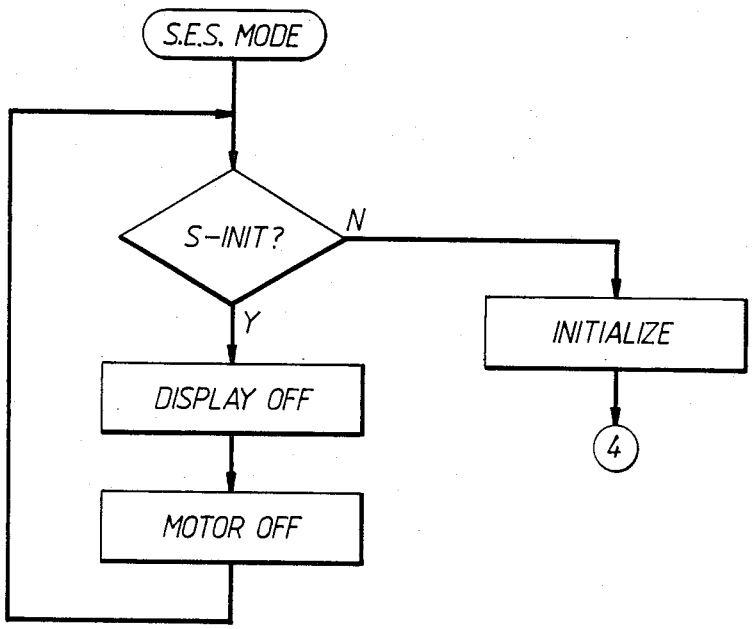

Referring to FIGS. 8(*a*), (*b*) and (*c*), a cooling fan is operated and controller 91 controls to initialize copying conditions and device status, when the power supply switch of main body 1 is closed. Next, fuser 26 is charged and heat rollers are heated. Controller 91 then checks if a toner bag is full of recovered toner. If the toner bag is full, a display is provided. If not, controller 91 checks if the temperature of fuser 26 is fixable. If the temperature of fuser 26 is not fixable, controller 91 checks if a predetermined time period will elapse. When the temperature of fuser 26 is fixable, it is judged that the machine is ready for initiating copying operation and executing the next step. When the temperature of fuser 26 is not fixable and the predetermined time period does not elapse, the judgment is repeated.

Next step, a malfunction in the machine is checked. If a malfunction is observed, a program for error processing is executed. If not, controller 91 checks if the machine is in interrupt copying mode.

In this embodiment, when key 72 is operated during interrupt copying mode, this mode is released and the INTRPT signal turns to low level. If key 74 is operated while the machine is not in interrupt copying mode, a program for energy saving mode is executed. If key 74 is not operated, controller 91 checks again if key 72 is operated. When key 72 is operated in this step, copying run according to interrupt copying mode will be executed and the INTRPT signal turns to high level.

In this case, the interrupt copying mode is a copying mode to be established by operating key 72 before one copy run is finished. After copying conditions for a previous copy run are stored in a memory of controller 91, copying conditions for another copy run may be set and thus copying operation in interrupt copying mode is permitted. When interrupt copying mode is released, copying conditions for the previous copy run are loaded in the work area of the memory and the previous copy run may be started again.

Then, copying conditions for copy quantity, copy sheet selection, exposure mode and copy magnification are established, by operating key 76, 78, 82, 83, 84 and 85. When establishing copy quantity, controller 91 checks if the set quantity is less than or equal to the allowable number of bins according to the S-MODEO and S-MODE1 signals. During this step for establishing copying conditions, the B-CLR signal is supplied to controller 94 once set copy quantity is cleared or changed.

Next, controller 91 checks if the S-AVAIL signal is input. If the S-AVAIL signal is low level, a sequence control program not including operation of sorter 30 will be executed.

Next, if the S-AVAIL signal is determined to be present, controller 91 checks if the S-BUSY signal is input. If the S-BUSY signal is low level, copying operation may be started in response to the operation of key 71. That is, the cleaning blade of cleaner 29*a* is pressed against drum 11, the main motor starts operation, and the original on platen 2 is scanned by optical system 10. Before this scanning operation, drum 11 is previously charged by charger 12, so electrostatic latent images are formed on the surface of drum 11 by exposure of optical system 10. These latent images are developed by developing device 13.

On the other hand, copy sheet P is fed from selected cassette 15 o 16 by feed rollers 17 and 18. Copy sheet P is transported to transferring station 22 by register rollers 21. Thus, the developed image on drum 11 is transferred on copy sheet P by charger 23. Then copy sheet P carrying transferred image is separated from drum 11 by charger 24, and is transported into fuser 26. The sheet with transferred image is heated and pressed by fuser 26. Therefore, the transferred image is fixed on copy sheet P. Sheet P is then sent into sorter 30 through discharge port 27*b*.

After transferring operation, residual toner on the surface of drum 11 is removed by cleaner 29*a* and residual charge on the surface of drum 11 is discharged by erase lamp 29*b*, so that drum 11 is ready for forming images repeatedly.

In this copying operation step, the C-RUN and EXIT signals are supplied to sorter 30. In response to the C-RUN and EXIT signals, controller 94 detects that main body 1 is during copying operation and copy sheet P is discharged, respectively.

Then, controller 91 checks if the copy run is performed. When the copy run is finished, the C-END signal is output. On the contrary, if the copy run has not been finished, copying operation to be performed is executed repeatedly. Responding to the C-END signal, controller 94 detects one copy run is completed. The S-INIT signal is output provided a predetermined time period elapses after execution of one copy run. In response to this S-INIT signal, the position of bin station 37 is initialized. If it has not timedout, the machine is left in standby status.

A timer for checking time-out is provided in controller 91. If the copying machine is not operated for a predetermined time period, the time period is counted down by the timer, so that the copying machine returns to in an initialized status. In this condition, the machine is in a priority mode in which most copying runs are executed.

The copying machine is set in its energy saving mode when key 74 is operated. In this mode, the electric power to be supplied to fuser 26 is reduced so that the temperature of fuser 26 is maintained at a temperature lower than a fixable temperature. All displays except display 75 are extinguished. Further, the S-INIT signal is output from controller 91. Next, controller 91 checks if a malfunction has occurred. If a malfunction has occurred, a program for error processing is executed.

If no malfunction is detected, controller 91 checks if key 74 or key 71 has been operated. If either has been operated the machine is initialized according to the operation of keys 71 and 74. Then, display 75 goes out and copying conditions are established in priority mode. Operation step returns to the routine shown in FIG. 8(*a*).

Referring to FIGS. 8(*d*) and (*e*), operation of sorter 30 is explained.

When the power supply switch of sorter 30 is closed, controller 94 checks if the S-INIT signal reaches a high level. If the signal is high level, sorter energy saving mode is established. If not, the operation mode of sorter 30 may be selected. An operator operates switches 53, 54 and 55, to select the desired mode. Display 57, 58 or 59, in response to the selected mode, is then activated by controller 94. Simultaneously, controller 94 actuates motor 97 to rotate cam 41 in the direction of arrow b. By this rotation of cam 41, bins 37*a*–37*j* are moved downward. This downward movement causes actuation of switch 42. Then controller 94 stops motor 97 according to signals from switch 42. Thus bin station 37 is established at its initial position.

On the other hand, controller 94 supplies the S-MODEO and S-MODE1 signals to controller 91. Therefore, controller 91 may detect the operation mode of sorter 30 in response to the S-MODEO and S-MODE1 signals.

Then, the operator operates print switch 71 so that a copy run is started. When a copy sheet passes discharge port 27*b*, controller 91 supplies the EXIT signal to controller 94. Sheet P is then transported into sorter 30 through passage 34. When the leading edge of copy sheet P reaches paper detection switch 35, switch 35 supplies a signal to controller 94. Controller 94 energizes motor 96 to rotate transportation rollers 36, in response to the signal. Thus, copy sheet P is transported by rollers 36 and is loaded on bin 37*a*.

In the non-sort mode, sheets P successively transported are loaded one-by-one on bin 37*a* by repetition of the above-mentioned operation. In sort mode, controller 94 energizes motor 97 to rotate cam 41, so that the storing bins 37*b*–37*j* are successively located at the outlet of passage 34 and sheets P are loaded one-by-one on bins 37*a*–37*j* in order. In group mode, controller 94 energizes motor 97 to rotate cam 41 responsive to the C-END signal, so that copied sheets of each group according to different originals are stored in a different bin.

If the energy saving key 74 is operated, energy saving mode is established. Controller 91 activates display 71. In this condition, the temperature of fuser 26 is established at lower than a fixable temperature and displays 78, 80 and 86 go out, so that less electric power is consumed. Also, controller 91 supplies the S-INIT signal to controller 94. Responding to this signal, controller 94 detects the machine is in energy saving mode, and it controls to extinguish displays 57–61 and to stop motors 96 and 97.

If energy saving key 74 is operated again, then energy saving mode is released. That is, display 75 goes out. Also, the temperature of fuser 26 returns to a fixable temperature. And displays 78, 80 and 86 are energized. Further, controller 91 causes the S-INIT signal to assume its low level. Responding to this operation, controller 94 initializes the position of bin station 37.

When the power supply of the copying machine is off, sorter 30 is operated in the same manner as in the above energy saving mode.

In the above embodiment, the present invention is applied to a copying machine, but may also be applied to a printer and a facsimile. Also, while the above operation has been described in conjunction with a sorter mounted on a copying machine, the present invention may also be applied to an optional feeder as an attachment.

In this specification, an attachment means a device having the following characteristics:

(1) It is not a device previously assembled in a copying machine, but it is optionally mounted on the machine according to user preference; and (2) It is used for enhancing the function of the machine.

Obviously, numerous modifications and variations of the present invention are possible in light of the above teachings. It is, therefore, to be understood that within the scope of the appended claims, the invention may be practiced otherwise than as specifically described herein.

What is claimed is:

1. An image forming apparatus with an attachment comprising:

means for forming an image on a recording medium;

means for supplying a first level of electric power for energizing said image forming means for image forming operation;

means for reducing the electric power supplied to said image forming means by said supplying means to a second level lower than the first level so that less electric power is consumed than during said image forming operation;

means for generating a control signal in response to the reduction of electric power supplied to said image forming means; and control means for maintaining the attachment in an inactive status in response to the control signal.

2. An image forming apparatus according to claim 1, wherein said image forming means comprises:

means for fixing the image on a copy sheet by heating the copy sheet.

3. An image forming apparatus according to claim 2, wherein said reducing means comprises:

means for reducing the electric power supplied to said fixing means such that said fixing means is held at a temperature lower than a temperature sufficient for fixing the image on the copy sheet.

4. An image forming apparatus according to claim 1, wherein said image forming means comprises:

means for discharging the recording medium carrying the image from a discharge port to which the attachment is connected, so that the recording medium discharged from the discharge port accumulates on the attachment.

5. An image forming apparatus according to claim 4, wherein the attachment includes a plurality of bins for receiving the recording medium discharged through the discharge port, said bins being mounted for moving upwardly and downwardly, respectively, and motor means for moving each of the bins upwardly and downwardly.

6. An image forming apparatus according to claim 5, wherein said control means stops said motor in the inactive status.

7. An image forming apparatus and attachment arrangement comprising:

an image forming apparatus adapted to alternately assume one of an operational mode in which said image forming apparatus consumes a first amount of energy and an energy saving mode in which said image forming apparatus consumes a second amount of energy less than said first amount of energy;

an attachment adapted to alternately assume an active mode and an inactive mode; and control means, incorporated in said image forming apparatus and connected to said attachment, for causing said attachment to assume said inactive mode when said image forming apparatus is in said energy saving mode.

8. An arrangement as claimed in claim 7, wherein said control means is also for causing said attachment to assume said active mode when said image forming apparatus is in said operational mode.

9. An arrangement as claimed in claim 7, wherein said attachment comprises a sorter.

10. An arrangement as claimed in claim 9, wherein said image forming apparatus is adapted to assume said energy saving mode by decreasing the temperature of a fuser located within said image forming apparatus, and by extinguishing a plurality of displays provided on said image forming apparatus.

11. An arrangement as claimed in claim 9, wherein said sorter is adapted to assume said inactive mode by turning off a sorter motor provided in said sorter, and by extinguishing a plurality of displays provided on said sorter.

12. An image forming apparatus and attachment arrangement comprising:

a fuser arranged in said image forming apparatus and adapted to alternately assume one of a fuser operational temperature and a fuser standby temperature less than said fuser operational temperature;

a display provided on said image forming apparatus and comprising a plurality of illuminated devices, and adapted to alternately assume one of a display operational mode in which said illuminated devices are supplied with power, and a display standby mode wherein said illuminated devices are not supplied with power;

control means for establishing an operational state in which said fuser assumes said fuser operational temperature and said display assumes said display operational mode, and a standby state in which said fuser assumes said standby temperature and said display assumes said display standby mode, and for providing a state indication of whether said image forming apparatus is in said operational state or said standby state;

a sorter attached to said image forming apparatus and adapted to assume one of a sorter operational mode and a sorter standby mode; and sorter control means, responsive to said image forming apparatus control means for causing said sorter to assume said operational mode when said state indication indicates that said image forming apparatus is in said operational state, and for causing said sorter to assume said standby mode when said state indication indicates that said image forming apparatus is in said standby state.

* * * * *